US007701123B2

(12) United States Patent
Wells et al.

(10) Patent No.: US 7,701,123 B2
(45) Date of Patent: Apr. 20, 2010

(54) ELECTRON SOURCE FOR IONIZATION WITH LEAKAGE CURRENT SUPPRESSION

(75) Inventors: Gregory J. Wells, Fairfield, CA (US); Edward G. Marquette, Oakland, CA (US)

(73) Assignee: Varian, Inc., Palo Alto, CA (US)

( * ) Notice: Subject to any disclaimer, the term of this patent is extended or adjusted under 35 U.S.C. 154(b) by 1150 days.

(21) Appl. No.: 11/301,588

(22) Filed: Dec. 13, 2005

(65) Prior Publication Data

US 2007/0132357 A1 Jun. 14, 2007

(51) Int. Cl.
*H01J 9/02* (2006.01)

(52) U.S. Cl. ..... 313/310; 313/495

(58) Field of Classification Search ..... 313/310, 313/495–497

See application file for complete search history.

(56) References Cited

U.S. PATENT DOCUMENTS 4,403,017 A 9/1983 Bind
5,543,625 A 8/1996 Johnson et al.
5,756,996 A 5/1998 Bier et al.
5,850,084 A 12/1998 Holkeboer
5,886,346 A 3/1999 Makarov
6,278,121 B1 8/2001 Laube et al.
6,294,780 B1 9/2001 Wells et al.
6,796,143 B2 9/2004 Clasen et al.

OTHER PUBLICATIONS

International Application No. PCT/US2006/047342, "PCT International Search Report", mailed on Mar. 3, 2008, 3 pages.

*Primary Examiner*—Bumsuk Won
(74) *Attorney, Agent, or Firm*—Bella Fishman; David P. Gloekler

(57) ABSTRACT

An electron source includes a first electrode, a second electrode, a thermionic element interposed between and electrically isolated from the first electrode and the second electrode, and a guard electrode interposed between and electrically isolated from the first electrode and the second electrode. The thermionic element and the guard electrode may be at substantially the same voltage. Another electron source includes a first electrode, a second electrode, a thermionic element interposed between and electrically isolated from the first electrode and the second electrode, and a thermal expansion component interposed between and electrically isolated from the first electrode and the second electrode. The thermal expansion component may be heated to cause expansion. The heating may be cycled to cause alternating expansion and contraction.

13 Claims, 6 Drawing Sheets

ELECTRON SOURCE FOR IONIZATION WITH LEAKAGE CURRENT SUPPRESSION

FIELD OF THE INVENTION

The present invention relates generally to ionization sources that provide ions to ion processing devices such as ion traps for applications such as mass spectrometry. More specifically, the invention relates to electron sources that provide electron beams to such ionization sources.

BACKGROUND OF THE INVENTION

Analytical processes such as mass spectrometry produce information acquired by processing charged species of sample analyte materials. The charged species are produced by ionizing the sample materials. Certain popular techniques for ionizing sample materials utilize a beam of energetic electrons. These techniques include electron ionization or impact (EI) and chemical ionization (CI). EI entails ionizing sample materials by transferring energy from the electrons to sample materials. CI entails ionizing a reagent gas by transferring energy from the electrons, and then ionizing sample materials by reactions with the ionized reagent gas. An electron source that includes a heated thermionic electrode, typically in the form of a filament, may be employed to produce the electron beam. Ion guiding techniques are employed to control the electron beam and focus the beam into an ionization chamber containing the typically gas-phase sample material. The chamber may be external to an ion processing device such as an ion trap or may be within the ion processing device.

The operation of an ion processing device, particularly a pulsed-operation device such as an ion trap, includes periods during which ionization is performed and periods during which ionization is not desired. Electrical circuitry communicates with the thermionic electrode as well as other electrodes utilized to control the electron beam. Depending on the configuration, the electron beam may be gated ON and OFF, adjusted between a HIGH state in which the electrons have sufficient energy to ionize sample material and a LOW state in which their energy is not sufficient to do so, or run continuously with the direction of the beam alternating toward and away from the ionization chamber. In all such configurations, control over and consistency of the electron emission current are desirable. Accordingly, the electrical circuitry associated with the electron source is typically capable of regulating the heating current passing through the thermionic electrode to maintain the total electron current at some constant, predetermined value.

Unfortunately, various components of the electron source are prone to becoming fouled with contaminating material, particularly when operating the CI mode of ionization. The contaminating material may be electrically conductive and thus may engender leakage currents. Leakage currents can cause several problems, including reducing the total emission current intended to be produced by the electron source, increasing electrical and/or photon noise, impairing the function of the emission current regulator and, more generally, impairing the accuracy and effectiveness of the associated ionization source.

In view of the foregoing, it would be advantageous to provide methods and apparatus that prevent, suppress, reduce, or eliminate leakage currents in electron sources, particular electron sources employed in conjunction with ion sources.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an electron source comprises a first electrode, a second electrode, a thermionic element interposed between and electrically isolated from the first electrode and the second electrode, and a guard electrode interposed between and electrically isolated from the first electrode and the second electrode.

According to another implementation, the thermionic element and the guard electrode are at substantially the same voltage, and the first electrode and the second electrode are at voltages different from the voltage on the thermionic element and the guard electrode.

According to another implementation, the electron source comprises an insulating material isolating the guard electrode from the first electrode, the second electrode and the thermionic element. The guard electrode has a first coefficient of thermal expansion and the insulating material has a second coefficient of thermal expansion different from the first coefficient of thermal expansion.

According to another implementation, an electron source comprises a first electrode, a second electrode, a thermionic element interposed between and electrically isolated from the first electrode and the second electrode, and a thermal expansion component interposed between and electrically isolated from the first electrode and the second electrode.

According to another implementation, the thermal expansion component is electrically conductive.

According to another implementation, the thermal expansion component includes a guard electrode, and the guard electrode and the thermionic element are at substantially the same voltage.

According to another implementation, the electron source comprises an insulating material isolating the thermal expansion component from the first electrode, the second electrode and the thermionic element. The thermal expansion component has a first coefficient of thermal expansion and the insulating material has a second coefficient of thermal expansion different from the first coefficient of thermal expansion.

According to another implementation, a method is provided for operating an electron source. A first voltage is applied to a thermionic element interposed between a first electrode and a second electrode to produce a current of emitted electrons from the thermionic element. A second voltage is applied, at substantially the same magnitude as the first voltage, to a guard electrode interposed between the first electrode and the second electrode.

According to another implementation, a voltage potential is applied between the first electrode and the second electrode to generate an electric field between the first electrode and the second electrode. The voltage potential may be adjusted to control the direction of the emitted electrons.

According to another implementation, a method is provided for operating an electron source. A first voltage is applied to a thermionic element interposed between a first electrode and a second electrode to cause emission of electrons from the thermionic element. A thermal expansion element interposed between the first electrode and the second electrode is heated to cause the thermal expansion element to expand in thickness.

According to another implementation, the heating is cycled to cause the thermal expansion element to alternately expand and contract.

DETAILED DESCRIPTION OF THE INVENTION

In general, the term "communicate" (for example, a first component "communicates with" or "is in communication with" a second component) is used herein to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

Figure 1:
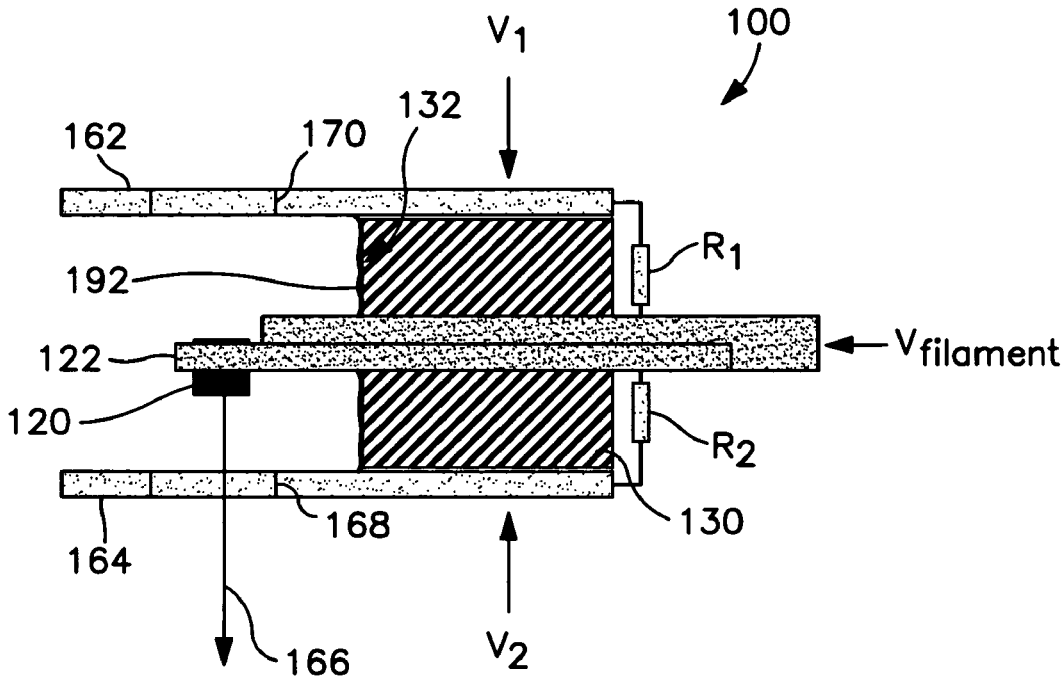
FIG. 1 (PRIOR ART)
FIG. 1 is a side elevation view of a known electron source employed in the ionization of sample analyte material.
Figure 2:
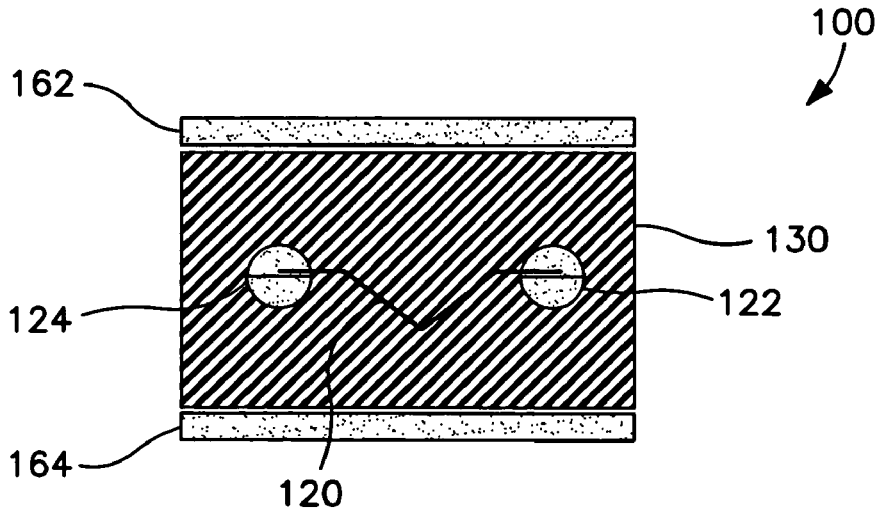
FIG. 2 (PRIOR ART)
FIG. 2 is a front elevation view of the known electron source illustrated in FIG. 1.

FIGS. 1 and 2 illustrate an example of a known electron emitter device or assembly 100. Such an assembly may be employed as an electron source for providing a beam (or stream) of electrons to an ionization chamber that in practice is situated externally to a suitable ion processing device such as an ion trap, mass filter, collision cell, ion cyclotron cell, or the like. Alternatively, such an assembly may be utilized to provide an electron beam directly into an ion processing device for effecting an internal ionization technique. An electron emitter device and an ionization chamber may be referred to collectively as an ionization device or ion source, which may be operated as a pulsed-ionization source as described below. The electron emitter device 100 illustrated in FIGS. 1 and 2 is typically employed in conjunction with either an electron ionization (EI) technique or chemical ionization (CI) technique. An example of a similar electron emitter device, and its operation in conjunction with an ionization chamber and the related components of a mass spectrometry (MS) system, is described in detail in U.S. Pat. No. 6,294,780, which is commonly assigned to the assignee of the present disclosure.

The known electron emitter device 100 includes a thermionic filament 120 that is supported between two filament posts 122 and 124. The filament 120 may be formed as a strip (ribbon) or a wire. The filament 120 may be constructed of any suitable refractory material such as tungsten, rhenium, or a compound, alloy or solid mixture containing a refractory material and that is capable of emitting electrons at or above a critical temperature. The filament posts 122 and 124 are supported in a block of electrically insulating material 130. The filament posts 122 and 124 extend for a distance beyond a face 132 of the insulating block 130 such that the filament 120 is positioned at a distance from this face 132. A top electrode 162 is disposed on one side of the insulating block 130 and a bottom electrode 164 is disposed on an opposite side of the insulating block 130. The top electrode 162 and the bottom electrode 164 extend for a distance beyond the face 132 of the insulating block 130 such that the filament 120 is positioned between respective portions of the top electrode 162 and the bottom electrode 164.

In operation, a suitable electrical circuit (not shown) applies a filament bias voltage $V_{filament}$ (e.g., typically −70 V for organic molecules) to the filament 120 to produce a heating current sufficient to cause thermionic emission of electrons from the filament 120 in a known manner. The electrical circuit also applies a voltage potential $V_1$ (e.g., ±124 V) to the top electrode 162, and a voltage potential $V_2$ (e.g., ±124 V) to the bottom electrode 164 to direct an electron beam 166 in the direction indicated in FIG. 1 into an ionization chamber (not shown) to ionize sample molecules or atoms in the ionization chamber, and alternately to direct the electron beam 166 away from the ionization chamber during stages of operation in which ionization is not desired (not shown). To direct the electron beam 166 into the ionization chamber, an electron extraction field is generated in the space between the top electrode 162 and the bottom electrode 164 by applying a negative voltage to the top electrode 162 and a positive voltage to the bottom electrode 164, such that the top electrode 162 serves as a repeller and the bottom electrode 164 serves as a focusing lens for the electrons emitted from the filament 120. The bottom electrode 162 may have an aperture 168 of any suitable shape through which the electron beam 166 is directed during an ionizing stage of operation. To direct the electron beam 166 toward the top electrode 162 (away from the bottom electrode 164 and thus away from the ionization chamber) during an non-ionizing stage of operation, the polarities of the respective voltages $V_1$ and $V_2$ applied to the top electrode 162 and the bottom electrode 164 are reversed. The electrical circuit may include a filament emission regulator control circuit (not shown) to regulate the heating current passing through the filament 120 such that the total electron current emitted from the surface of the filament 120 due to thermionic emission is maintained at a constant, predetermined value.

To improve the symmetry of the electric field between the top electrode 162 and the bottom electrode 164 during the reversed-polarity stage in which the electron beam 166 is directed away from the bottom electrode 164, the top electrode 162 may likewise have an aperture 170 of the same shape and position as the aperture 168 of the bottom electrode 164. It will also be noted that, apart from the opposite polarities, the magnitudes of the respective voltages $V_1$ and $V_2$ applied to the top electrode 162 and the bottom electrode 164 may generally be the same if the filament 120 is interposed equidistantly between the top electrode 162 and the bottom electrode 164. Otherwise, the respective magnitudes may need to be adjusted differently to optimize operation during the ON and OFF stages of ionization.

The electron emitter device 100 illustrated in FIGS. 1 and 2 may be utilized as a constant emission device to produce a constant electron-energy beam both during ionization and between periods of ionization. In essence, only the direction of the electron beam 166 is varied in such a case, in that the beam 166 is controllably switched toward or away from the ionization chamber depending the whether ionization is to be performed, as described above. Generally, this electron emitter device 100 and its method of use provide advantages as described in above-cited U.S. Pat. No. 6,294,780, such as improving the consistency of the ionization process, reducing contamination in the ionization chamber, and preserving the physical integrity of the filament. It has now been found, however, that an electron emitter device 100 of this type functions most adequately when performing EI at low pressure. On the other hand, it has been found that when operating an ion source in the CI mode, which requires high pressures of a reaction gas such as methane or isobutane, contaminating material may develop on various components of the electron emission device 100. Such contaminating material may include electrically conductive material, such as carbon as a result of CI-related reactions, as well as other types of conductive materials such as rhenium from the filament 120 that condense on the exposed surfaces of the electron emission device 100 after vaporizing from the hot filament 120. For example, FIG. 1 illustrates a layer of contaminating material 192 deposited on the face 132 of the insulating block 130 between the filament posts 122 and 124 and the top electrode 162 and the bottom electrode 164. Such contaminating material 192 if electrically conductive may form an electrical bridge between these conductive components.

As schematically illustrated in FIG. 1, for example, the contaminating material 192 has formed a low impedance path, indicated by resistive elements $R_1$ and $R_2$, between the top electrode 162 and the bottom electrode 164 to which the respective voltages $V_1$ and $V_2$ are applied. As a result, an electrical leakage current, defined as $I_{leakage\text{-}1}=V_1/R_1$ and $I_{leakage\text{-}2}=V_2/R_2$, causes the emission current regulator of the above-mentioned electrical circuit to go out of regulation by injecting a spurious current into the feedback portion of the circuit that is not related to the actual electron emission from the filament 120. Other ionization sources of the prior art have employed continuous-electron beams derived from the heated filament and focused into the ionization region of the ion source. The pulsed-ionization source described above, however, reverses the direction of the ionizing electron beam 166 by means of the two lenses (top electrode 162 and bottom electrode 164) disposed on either side of the filament 120 and held at voltages $V_1$ and $V_2$ of opposite polarity. Changing the direction of the electron beam 166 requires changing the polarity and magnitude of the lenses 162 and 164. The leakage resistances, $R_1$ and $R_2$, and the lens voltages, $V_1$ and $V_2$, are not necessarily the same. It follows that every time the electron beam 166 reverses its direction, the leakage current entering the feedback portion of the filament emission regulator circuit will change abruptly and cause the circuit to go out of regulation. Emission regulator circuits necessarily have long response time constants in response to a change in the error signal because of the long thermal time constant of the filament 120. Thus, any abrupt perturbation will upset the control loop for a substantial length of time. It is difficult to protect the filament 120 by slowing the response down. By the time the response is slow enough, the circuit does not perform its regulating function well. Current limiting is generally used instead.

By way of example, the implementations of electron sources and related components, ionization devices and methods described below are provided to address these problems.

Figure 3:
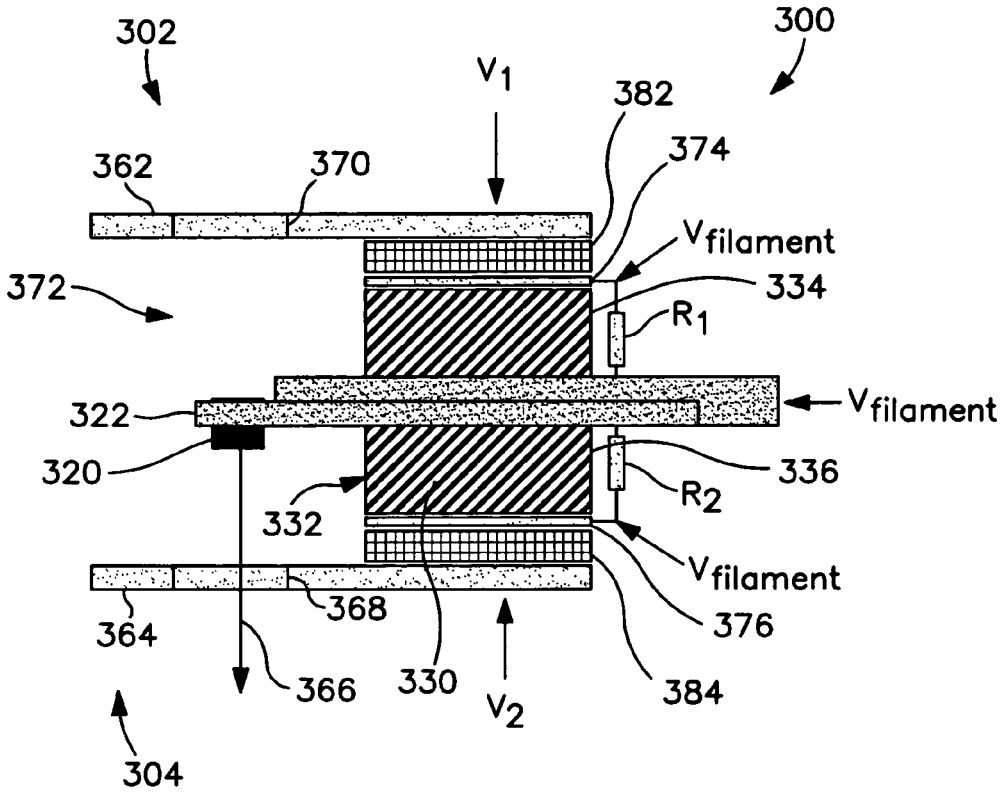
FIG. 3 is a side elevation view of an electron source provided according to implementations described in the present disclosure.
Figure 4:
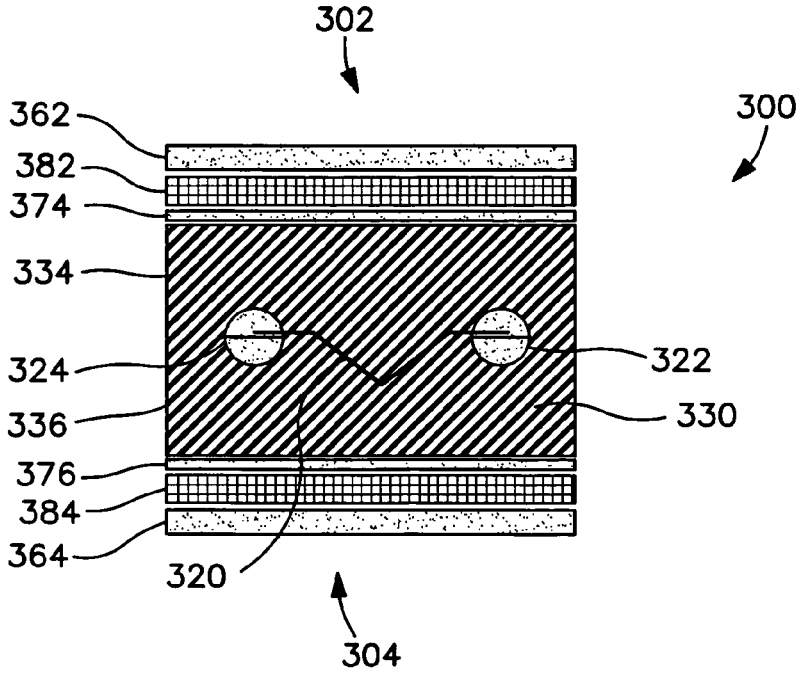
FIG. 4 is a front elevation view of the electron source illustrated in FIG. 3.

FIGS. 3 and 4 illustrate an example of an electron emitter device or assembly, electron source 300, according to implementations described in the present disclosure. The electron source 300 generally has a first side 302 and an opposing second side 304 from which the various components of the electron source 300 may be referenced for descriptive purposes. The electron source 300 includes a thermionic element 320 such as a filament or electrode. The structure and composition of the thermionic element 320 may be similar to known thermionic elements. The thermionic element 320 may be mounted on, attached to, supported by, or otherwise maintained in an essentially fixed position by one or more structural components 322 and 324 such as filament posts. The structural components 322 and 324 may be electrically conductive to facilitate feeding a heating current to the thermionic element 320, in which case the structural components 322 and 324 may be considered as being part of the thermionic element 320, electrical extensions of the thermionic element 320, or interconnects between the thermionic element 320 and any electrical circuit communicating with the thermionic element 320.

The structural components 322 and 324 are supported, surrounded or encased by a body or arrangement of electrically insulating material 330. The insulating material 330 may have a unitary construction that includes one portion 334 generally disposed on the first side 302 of the thermionic element 320 and structural components 322 and 324 and another portion 336 generally disposed on the second side 304 of the thermionic element 320 and structural components 322 and 324. Alternatively, the insulating material 330 may include one or more blocks, substrates, layers, portions or the like as needed to electrically isolate the thermionic element 320 from other components of the electron source 300. For instance, the thermionic element 320 and the structural components 322 and 324 may be considered as being interposed between a first or upper portion 334 of insulating material 330 and a second or lower portion 336 of insulating material 330. The structural components 322 and 324 may generally extend for a distance beyond a face or side 332 of the insulating material 330 such that the thermionic element 320 is positioned at a distance from this face 332.

A first or upper electrode 362 is disposed on the first side 302 of the thermionic element 320 and spaced at a distance from the thermionic element 320, and a second or lower electrode 364 is disposed on the second side 304 of the thermionic element 320 and spaced at a distance from the thermionic element 320. The first electrode 362 and the second electrode 364 may extend for a distance beyond the face 332 of the insulating material 330 such that the thermionic element 320 is positioned between respective portions of the first electrode 362 and the second electrode 364. Accordingly, a region 372 in space is defined between the first electrode 362 and the second electrode 364 in which electrons may be thermionically emitted and subjected to controlled electrical fields. A voltage potential may be applied between the first electrode 362 and the second electrode 364 to control the excursions of the electrons emitted from the thermionic element 320. In some implementations, the first electrode 362 and the second electrode 364 may be operated alternatively as repellers and lenses in the known manner of pulsed ionization devices.

The first electrode 362 and the second electrode 364 may be constructed from any electrically conductive material and have any shape suitable for applying an electrical field for controlling an electron beam 366 emitted from the thermionic element 320. In some implementations, the first electrode 362 and the second electrode 364 are generally planar, and may be shaped as flat or substantially flat plates. The thermionic element 320 may be generally equidistantly spaced from the first electrode 362 and the second electrode 364, or alternatively may be positioned closer to one of these electrodes 362 or 364 than to the other electrode 364 or 362. The second electrode 364 may have an aperture 368 through which the electron beam 366 is directed into an ionization chamber (not shown), and the first electrode 362 may likewise have an aperture 370 to improve symmetry as previously noted.

As also illustrated in FIGS. 3 and 4, the electron source 300 may additionally include one or more guard electrodes interposed between the thermionic element 320 and structural components 322 and 324 and the respective first electrode 362 and second electrode 364. In some embodiments, two opposing guard electrodes 374 and 376 are respectively disposed on the first side 302 and the second side 304 of the thermionic element 320 and structural components 322 and 324, and interposed between the thermionic element 320 and structural components 322 and 324 and the respective first electrode 362 and second electrode 364. In the example specifically illustrated in FIGS. 3 and 4, an upper guard or third electrode 374 is interposed between the first electrode 362 and the thermionic element 320 and structural components 322 and 324, and a lower guard or fourth electrode 376 is interposed between the second electrode 364 and the thermionic element 320 and structural components 322 and 324. In other implementations, the third and fourth electrodes 374 and 376 illustrated in FIGS. 3 and 4 represent the cross-sections of a single guard electrode. The guard electrodes or electrode sections 374 and 376 may be constructed from any electrically conductive material and may have any shape suitable for addressing the problem of leakage current as described below. In some implementations, the guard electrodes or electrode sections 374 and 376 have planar shapes as in the case of the first electrode 362 and the second electrode 364, as illustrated in FIGS. 3 and 4.

To electrically isolate the thermionic element 320 from the guard electrode(s) 374 and 376, the first portion 334 of the insulating material 330 is interposed between the guard electrode 374 and the thermionic element 320 and structural components 322 and 324 and the second portion 336 of the insulating material 330 is interposed between the guard electrode 376 and the thermionic element 320 and structural components 322 and 324. To electrically isolate the first electrode 362 and second electrode 364 from the guard electrode (s) 374 and 376, respectively, additional insulating material may be provided. In the example specifically illustrated in FIGS. 3 and 4, a third portion 382 of insulating material 330 is interposed between the first electrode 362 and the guard electrode 374, and a fourth portion 384 of insulating material 330 is interposed between the second electrode 364 and the guard electrode 376. As previously noted, the first portion 334, second portion 336, third portion 382, and fourth portion 384 of insulating material 330 may comprise a unitary structure of insulating material, or alternatively one of more portions 334, 336, 382 and 384 may be separate from the other portions 334, 336, 382 and 384.

A suitable electrical circuit, which will be referred to as an electron emission controller (not shown), may be provided that includes one or more power supplies communicating with the thermionic element 320, the first electrode 362, the second electrode 364, and the guard electrode(s) 374 and 376. In operation, the electron emission controller applies a voltage bias $V_{filament}$ to the thermionic element 320 to produce a heating current sufficient for inducing thermionic emission, as well as a voltage potential $V_1$ to the first electrode 362 and a voltage potential $V_2$ to the second electrode 364 at appropriate magnitudes and polarity to control the direction of the resulting electron beam 366 in a manner similar to that previously described. In addition, the electron emission controller may also apply the same or substantially the same voltage bias $V_{filament}$ to the guard electrode(s) 374 and 376. The electron emission controller may include circuitry for regulating the heating current such that the total electron current emitted from the thermionic element 320 is maintained at a constant, predetermined value, such as by operating voltage regulators and/or current limiters as appreciated by persons skilled in the art.

The electron source 300 described above and illustrated by example in FIGS. 3 and 4 prevents an ionization device from running out of regulation due to spurious electrical leakage currents such as may be caused by the build-up of electrically conductive deposits that bridge conductive elements of the electron source 300, particularly as a result of operating in the CI mode. As the guard electrode(s) 374, 376 are maintained at the same bias potential $V_{filament}$ as the thermionic element 320, any leakage current that may occur flows between the first and second electrodes 362 and 364 and the guard electrode(s) 374, 376 due to the existing potential differences $V_{filament}-V_1$ and $V_{filament}-V_2$. The power supplies for all three electrodes (first electrode 362, second electrode 364, and guard electrode(s) 374, 376) can easily have enough current capacity to handle leakage currents that would otherwise overwhelm the emission regulator circuit of the electron emission controller. Accordingly, the electron source 300 provides improved control over the electron emission from the thermionic element 320 in both EI and CI modes of operation. When utilized for pulsed ionization, the electron source 300 helps to ensure the realization of advantages such as described in above-cited U.S. Pat. No. 6,294,780 for both EI and CI modes.

Figure 5:
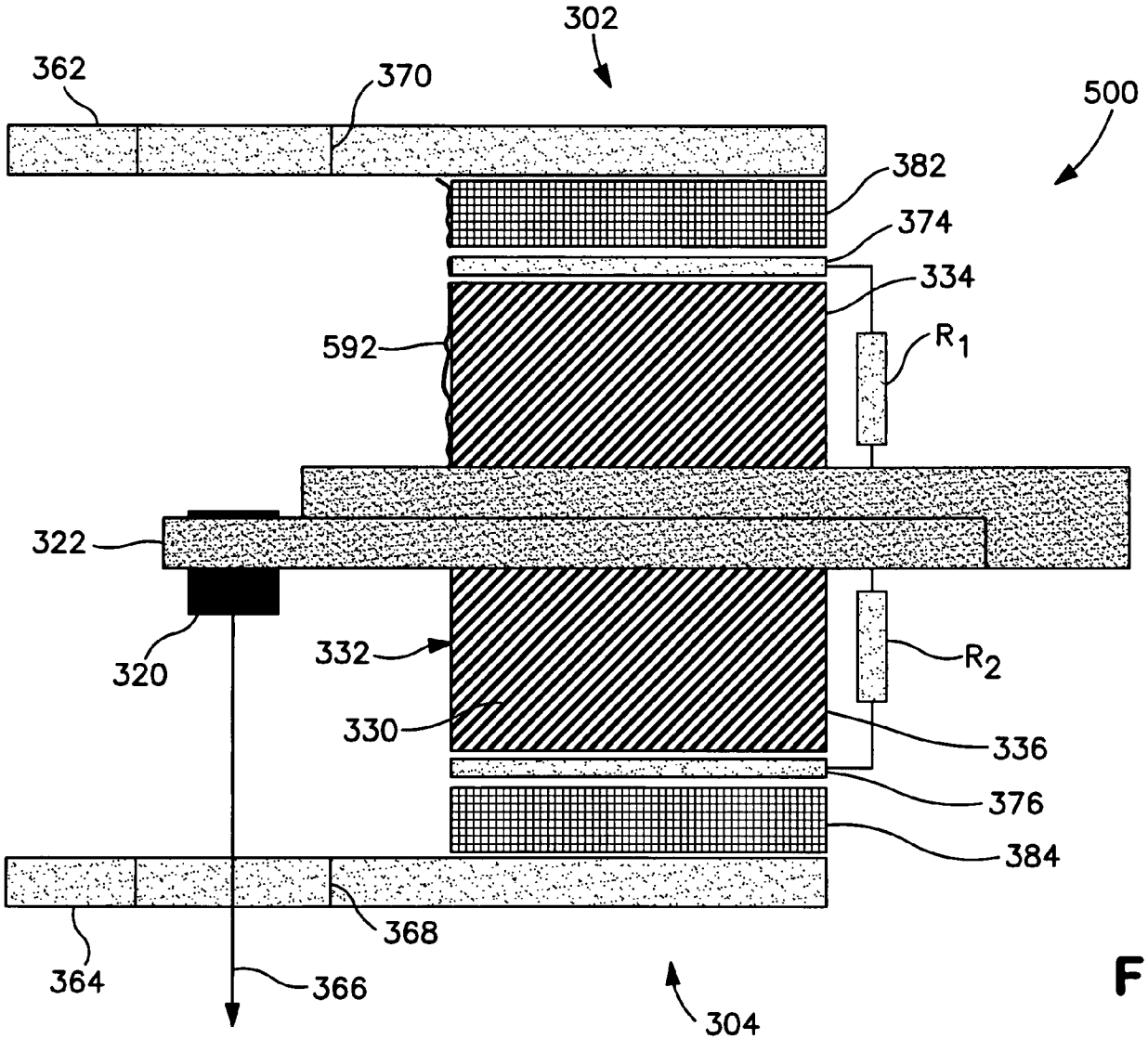
FIG. 5 is a side elevation view of an electron source provided according to other implementations described in the present disclosure.

FIG. 5 illustrates an example of an electron source 500 according to other implementations provided in the present disclosure. The components of the electron source 500 illustrated in FIG. 5 that are similar to those illustrated in FIGS. 3 and 4 are indicated by like reference numerals and their descriptions need not be repeated. The electron source 500 illustrated in FIG. 5 includes one or more components, such as a heating element or thermal expansion element, that function as one or more expansion joints as an alternative or additional means for reducing leakage current. The component utilized as an expansion joint may be any pre-existing component of the electron source 500 or may be a component that is added to the electron source 500 for this purpose. In either case, the component is positioned at a location where the development of a conductive deposit that results in a detrimental leakage current is likely to occur, such as the conductive deposit 592 illustrated in FIG. 5. In some implementations, the component is electrically conductive and thus operates as a resistive heating element.

In the non-limiting example illustrated in FIG. 5, the guard electrode(s) 374, 376 advantageously functions as one or more expansion joints. For this purpose, the guard electrode (s) 374, 376 may be fabricated of a material with a high linear thermal expansion coefficient such as, but not limited to, pure aluminum (about $25.0\times10^{-6\circ}$ C.$^{-1}$), and 2017 aluminum alloy (about $22.9\times10^{-6\circ}$ C.$^{-1}$). The thermal expansion coefficient of the guard electrode(s) 374, 376 may be significantly different from thermal expansion coefficient of the adjacent insulating portions 334, 336, 382 and 384, such that the guard electrode(s) 374, 376 and the insulating portions 334, 336, 382 and 384 dilate at different rates in response to a given change in temperature. As examples, the insulating portions 334, 336, 382 and 384 may be fabricated from materials with a relatively low linear thermal expansion coefficient, such as cordierites ($2MgO\text{-}2Al_2O_3\text{-}5SiO_2$); modified cordierites in which at least a portion of the silicon dioxide is replaced with germanium dioxide ($2MgO\text{-}2Al_2O_3$—$(5\text{-}x)SiO_2\text{-}xGeO_2$ where x ranges from about 0 to about 5) and having a thermal expansion coefficient of about $1.2\times10^{-7\circ}$ C.$^{-1}$, such as described in U.S. Pat. No. 4,403,017; ultra-low-expansion (ULE) glasses; and glasses that include one or more oxide-containing compounds such as silica glasses and $SiO_2$—$TiO_2$ glasses (less than or equal to about $5.0\times10^{-7}$° $C.^{-1}$), such as described in U.S. Pat. No. 6,796,143. It will be appreciated that thermal expansion coefficients may vary with temperature.

As a further non-limiting example, the insulating material 330 has a coefficient of thermal expansion of about $1.0\times10^{-6}$° $C.^{-1}$ or less, and the guard electrode(s) 374, 376 has a linear coefficient of thermal expansion that is significantly greater, for example about an order of magnitude greater. In another example, the guard electrode(s) 374, 376 has a linear coefficient of thermal expansion of about $1.0\times10^{-5}$° $C.^{-1}$ or greater, and the insulating material 330 has a coefficient of thermal expansion of about $5.0\times10^{-7}$° $C.^{-1}$ or less. In another example, the guard electrode(s) 374, 376 has a linear coefficient of thermal expansion ranging from about $20\times10^{-6}$ to about $25\times10^{-6}$° $C.^{-1}$, and the insulating material 330 has a coefficient of thermal expansion ranging from about $1.0\times10^{-7}$ to about $5.0\times10^{-7}$° $C.^{-1}$.

The thermionic element 320 may be turned ON and OFF as part of the normal operation of the associated ion source. This causes the temperature of the various components of the electron source 500 to change over a large range. By providing one or more guard electrode(s) 374, 376 or any other suitably located thermal expansion element to serve as an expansion joint, the implementation illustrated in FIG. 5 introduces a differential thermal expansion relative to the insulating material 330 that renders the temperature cycling of the electron source 500 in response to the cycling of power applied to the thermionic element 320 more significant than would otherwise be the case in the absence of thermal expansion elements. Specifically, the differential thermal expansion of the guard electrode(s) 374, 376 causes any electrically conducting deposits 592 that may have created electrical bridges to separate as illustrated in FIG. 5, thereby breaking the low impedance electrical path through the deposit 592 and in turn eliminating the leakage current associated with such deposits 592.

It will be noted that the advantages provided by the implementations described above, such as preventing loss of regulation, reducing noise, and eliminating or at least minimizing leakage current, extend beyond applications entailing pulsed ionization. Any ion source, including those that provide an electron beam on a continuous basis and those that gate an electron beam between HIGH and LOW or ON and OFF states, may be adversely affected by leakage currents. For instance, an electron source of any given type may be set to provide an electron emission at 100 μA but may actually operate with a leakage of 20 μA such that the effective emission is only 80 μA. Any such electron source would benefit from cleaner current emission and reduced leakage as a result of practicing the implementations described above such as providing a guard electrode and/or an expansion joint. Therefore, the implementations described in the present disclosure are not limited to pulsed ionization applications.

Figure 6:
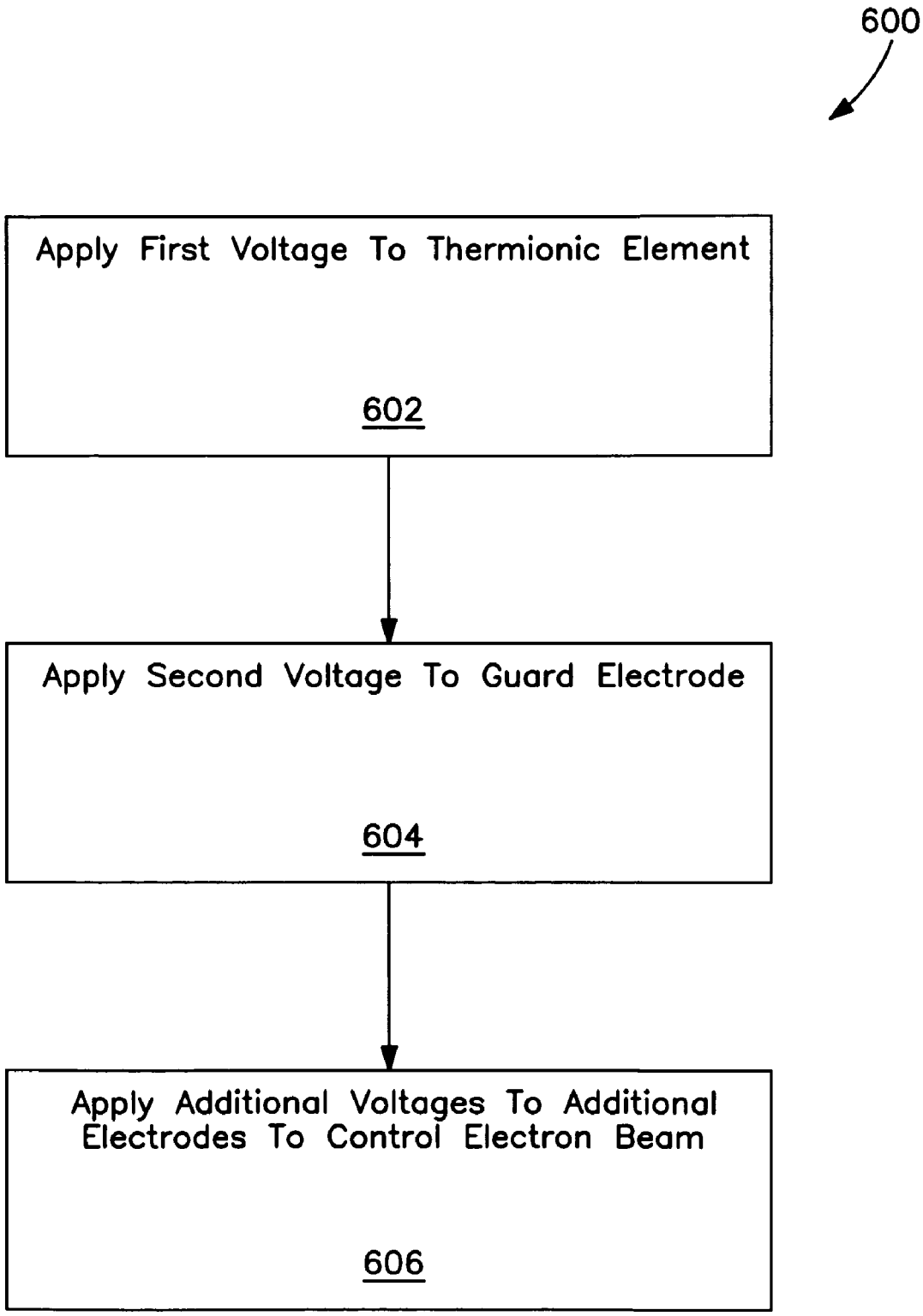
FIG. 6 is a flow diagram illustrating methods in accordance with implementations described in the present disclosure.

FIG. 6 is a flow diagram 600 illustrating examples of methods for operating an electron source such as the electron source 300 or 500 described above and illustrated in FIGS. 3-5. The flow diagram 600 may also represent an electron source capable of performing the methods, an ion source that includes the electron source, or a related system such as a mass spectrometry (MS) system that includes the electron source. At block 602, a first voltage is applied to a thermionic element provided with the electron source. The thermionic element is heated to provide a current of emitted electrons. At block 604, a second voltage is applied to a guard electrode provided with the electron source. As described above, the second voltage may be the same or substantially the same as the first voltage to facilitate suppressing or eliminating any leakage current. At block 606, additional voltages may be applied to additional electrodes as needed to control the electron beam produced from the thermionic element, such as for implementing any suitable continuous or pulsed ionization operation.

Figure 7:
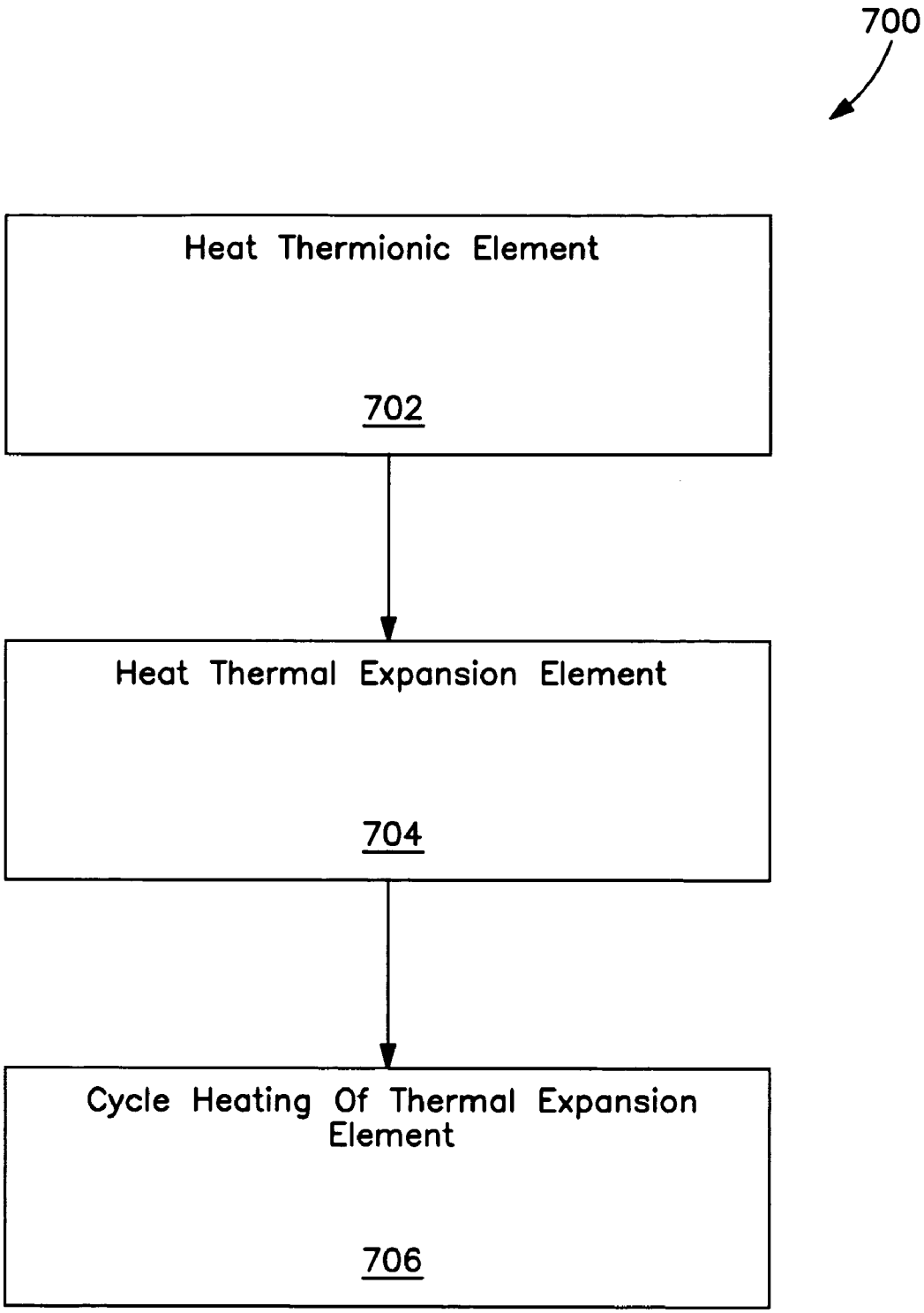
FIG. 7 is a flow diagram illustrating methods in accordance with other implementations described in the present disclosure.

FIG. 7 is a flow diagram 700 illustrating examples of methods for operating an electron source such as the electron source 300 or 500 described above and illustrated in FIGS. 3-5. The flow diagram 700 may also represent an electron source capable of performing the methods, an ion source that includes the electron source, or a related system that includes the electron source such as an MS system. At block 702, a thermionic element is heated to cause the emission of electrons. At block 704, a thermal expansion element is heated to cause expansion of the thermal expansion element. The thermal expansion is useful for breaking up any electrically conductive deposit on the electron source that may be providing a flowpath for leakage current. As described above, a guard electrode may be provided to serve as the thermal expansion element. At block 706, the heating of the thermal expansion element may be cycled to consequently cycle expansion and contraction of the thermal expansion element, which may further facilitate the breaking up of any deleterious conductive deposit.

Additional implementations may include combinations of one or more steps illustrated in FIGS. 6 and 7.

Figure 8:
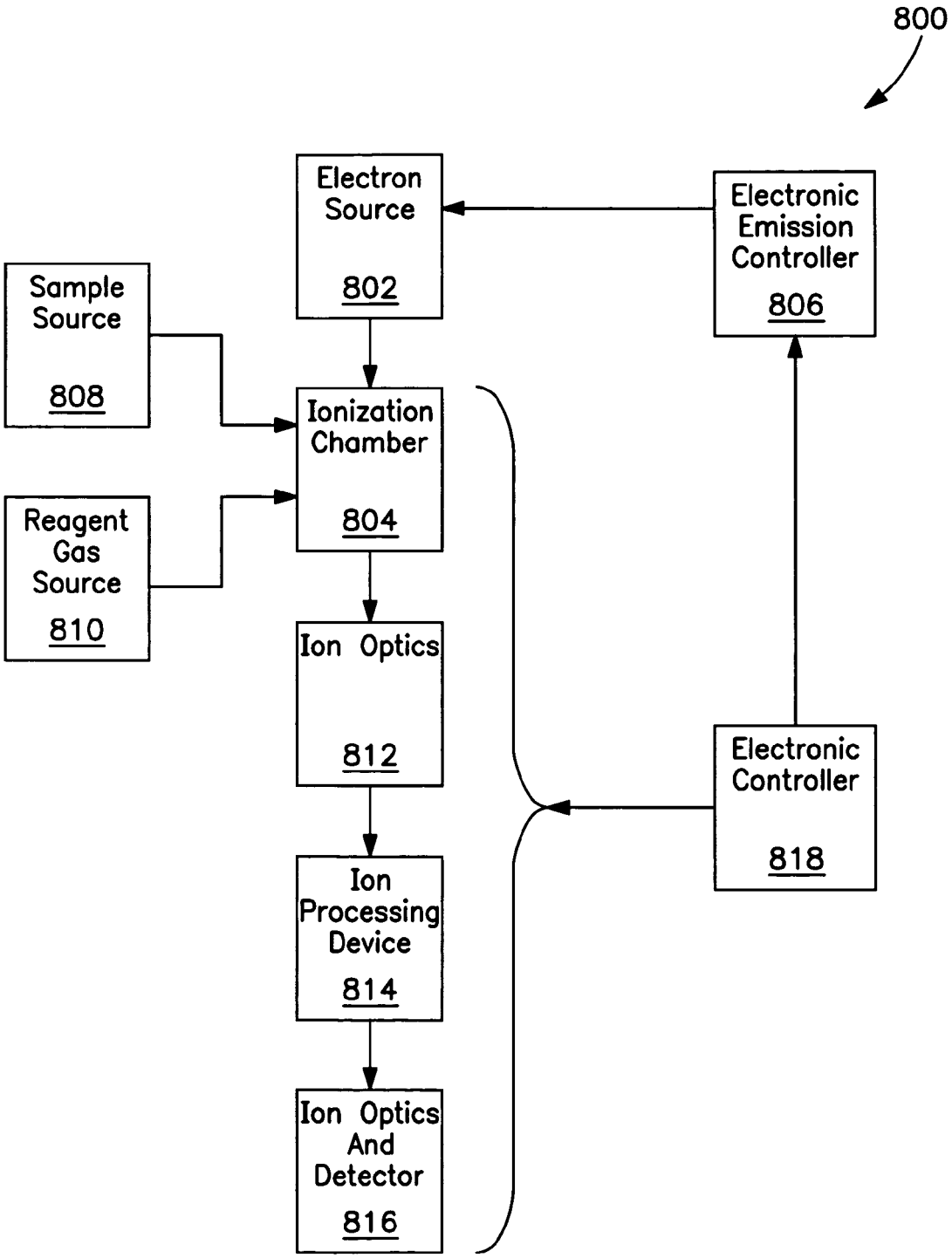
FIG. 8 is a schematic diagram of an ion source and related components of a mass spectrometry system.

FIG. 8 is a highly generalized and simplified schematic diagram of an example of a system such as a mass spectrometry (MS) system 800. The MS system 800 illustrated in FIG. 8 is but one example of an environment in which implementations described in the present disclosure are applicable. Apart from their utilization in implementations described in the present disclosure, the various components or functions depicted in FIG. 8 are generally known and thus require only brief summarization.

The MS system 800 includes an electron source 802 that may be configured like the electron source 300 or 500 described above and illustrated in FIGS. 3-5. The electron source 802 produces a stream of electrons that may be directed into an ionization chamber 804. The electron source 802 may be controlled by a suitable electronic emission controller 806 that may include circuitry and functional entities such as those described above. A suitable sample source 808, such as a gas chromatographic (GC) instrument or a liquid chromatographic (LC) instrument with a vaporizer, may be provided to introduce a stream of gaseous sample analyte material into the ionization chamber 804. A reagent gas source 810 may be provided to introduce a suitable reagent gas into the ionization chamber 804 for performing a CI mode of ionization. It will be noted that the MS system 800 may be capable of performing either EI or CI as desired. The electron source 802, ionization chamber 804, and related components may collectively be referred to as an ion source or ionization device.

After the sample material is ionized in the ionization chamber 804, the charged species are directed through suitable ion optics 812 into any suitable ion processing device 814 such as an ion trap. In some implementations, instead of employing an external ionization chamber 804, the ion-occupied volume within the ion processing device 814 may serve as the ionization chamber. As part of such in-trap ionization techniques, an AC field may be applied within the ion processing device 814 in a known manner to increase the kinetic energy of the incoming electron beam to a level sufficient for ionizing the sample material. The ion processing device 814 may be employed in any desired manner, after which selected ions may be directed to ion optics and detector 816 for measurement. The data from the resulting signals may be employed to generate mass spectra in a known manner. As schematically illustrated in FIG. 8, the various components and functional entities of the MS system 800 may communicate with and be controlled by any suitable electronic controller 818. The electronic controller 818 may represent one or more computing or electronic-processing devices, and may include both hardware and software attributes. The electronic controller 818 may execute or control, in whole or in part, one or more steps of the methods described in the present disclosure.

It will be understood that the methods and apparatus described in the present disclosure may be implemented in an MS system 800 as generally described above and illustrated in FIG. 8 by way of example. The present subject matter, however, is not limited to the specific MS system 800 illustrated in FIG. 8 or to the specific arrangement of circuitry and components illustrated in FIG. 8. Moreover, the present subject matter is not limited to MS-based applications.

The subject matter described in the present disclosure may also find application to ion sources that provide ions for ion traps of the type that operate based on Fourier transform ion cyclotron resonance (FT-ICR). These types of ion traps employ a magnetic field to trap ions and an electric field to eject ions from the trap (or ion cyclotron cell). The subject matter may also find application to ion sources that provide ions for static electric traps such as described in U.S. Pat. No. 5,886,346. Apparatus and methods for implementing these ion trapping and mass spectrometric techniques are well-known to persons skilled in the art and therefore need not be described in any further detail herein.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. An electron source comprising:

a first electrode maintained at a first voltage potential;

a second electrode maintained at a second voltage potential;

a first insulator adjacent to the first electrode;

a second insulator adjacent to the second electrode that is positioned between the first and second insulators;

a thermionic element interposed between and electrically isolated from the first electrode and the second electrode and maintained at a voltage potential substantially different from the first and the second electrode, the thermionic element adjacent to the second insulator; and at least one guard electrode interposed between and electrically isolated from the first electrode and the second electrode.

2. The electron source of claim 1, wherein the thermionic element and the at least one guard electrode are at substantially the same voltage.

3. The electron source of claim 1, comprising means for applying substantially the same voltage to the thermionic element and to the guard electrode.

4. The electron source of claim 3, comprising means for applying voltages to the first electrode and the second electrode different from the voltage applied to the thermionic element and the guard electrode.

5. The electron source of claim 1, further comprising a first and a second guard electrodes, wherein the first guard electrode is interposed between the first electrode and the thermionic element on a first side of the thermionic element, and the second guard electrode is interposed between the second electrode and the thermionic element on a second side of the thermionic element.

6. The electron source of claim 1, wherein the at least one guard electrode includes a third electrode interposed between the first electrode and the thermionic element and a fourth electrode interposed between the second electrode and the thermionic element.

7. The electron source of claim 1, comprising an insulating material isolating the at least one guard electrode from the first electrode, the second electrode and the thermionic element, wherein the at least one guard electrode has a first coefficient of thermal expansion and the insulating material has a second coefficient of thermal expansion different from the first coefficient of thermal expansion.

8. An electron source comprising:

a first electrode maintained at a first voltage potential;

a second electrode maintained at a second voltage potential;

a first insulator contacting the first electrode;

a second insulator contacting the second electrode;

a thermionic element interposed between and electrically isolated from the first electrode and the second electrode and maintained at a voltage potential substantially the same as the second electrode, the thermionic element adjacent to the second insulator; and a thermal expansion component interposed between and electrically isolated from the first electrode and the second electrode.

9. The electron source of claim 8, wherein the thermal expansion component is electrically conductive.

10. The electron source of claim 8, wherein the thermal expansion component includes a guard electrode, and the guard electrode and the thermionic element are at substantially the same voltage.

11. The electron source of claim 8, comprising an insulating material isolating the thermal expansion component from the first electrode, the second electrode and the thermionic element, wherein the thermal expansion component has a first coefficient of thermal expansion and the insulating material has a second coefficient of thermal expansion different from the first coefficient of thermal expansion.

12. The electron source of claim 11, wherein the first coefficient of thermal expansion is greater than the second coefficient of thermal expansion.

13. The device of claim 8, wherein the thermal expansion component has a linear coefficient of thermal expansion of about $1.0\times10^{-5\circ}$ C.$^{-1}$ or greater.

* * * * *